US008651836B2

(12) United States Patent
Parmeter et al.

(10) Patent No.: US 8,651,836 B2
(45) Date of Patent: Feb. 18, 2014

(54) TORQUE TRANSMITTING RINGS FOR SLEEVES IN ELECTRICAL SUBMERSIBLE PUMPS

(75) Inventors: Larry J. Parmeter, Broken Arrow, OK (US); Van J. McVicker, Collinsville, OK (US); Brett D. Leamy, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 277 days.

(21) Appl. No.: 13/083,192

(22) Filed: Apr. 8, 2011

(65) Prior Publication Data

US 2012/0257985 A1 Oct. 11, 2012

(51) Int. Cl.
*F04B 35/04* (2006.01)

(52) U.S. Cl.
USPC ..... 417/423.12; 417/423.3

(58) Field of Classification Search
USPC ..... 417/53, 319, 360, 423.3, 423.6, 423.11, 417/423.12, 424.1; 464/18, 41, 64, 70, 81, 464/91
See application file for complete search history.

(56) References Cited

U.S. PATENT DOCUMENTS

| | | | | |
|---|---|---|---|---|
| 2,620,165 | A * | 12/1952 | Crickmer | 464/20 |
| 2,644,671 | A * | 7/1953 | Ingram | 175/354 |
| 2,848,884 | A * | 8/1958 | Maude | 464/30 |
| 4,162,619 | A * | 7/1979 | Nixon, Jr. | 464/20 |
| 4,772,245 | A | 9/1988 | Readman et al. | |
| 4,989,909 | A * | 2/1991 | Bouligny et al. | 294/119.3 |
| 5,923,111 | A * | 7/1999 | Eno et al. | 310/156.25 |
| 6,379,127 | B1 | 4/2002 | Andrews | |
| 6,566,774 | B2 | 5/2003 | Parmeter | |
| 7,492,069 | B2 * | 2/2009 | Knox et al. | 310/87 |
| 7,665,975 | B2 | 2/2010 | Parmeter | |
| 7,808,140 | B2 | 10/2010 | Cain | |
| 7,909,090 | B2 | 3/2011 | Reid | |
| 2010/0202896 | A1 | 8/2010 | Du | |

FOREIGN PATENT DOCUMENTS

| | | | |
|---|---|---|---|
| WO | 2009023665 | A2 | 2/2009 |
| WO | 2010051197 | A2 | 5/2010 |
| WO | WO 2010/092320 | A1 | 8/2010 |

OTHER PUBLICATIONS

U.S. Appl. No. 12/877,769, filed Sep. 8, 2010.
U.S. Appl. No. 12/938,160, filed Nov. 2, 2010.
International Search Report and Written Opinion (PCT/US2012/030650), dated Oct. 16, 2012.

* cited by examiner

*Primary Examiner* — Devon Kramer
*Assistant Examiner* — Charles W Nichols
(74) *Attorney, Agent, or Firm* — Bracewell & Giuliani LLP

(57) ABSTRACT

An electrical submersible pump assembly has a motor module coupled to a centrifugal pump module by a seal section module. A shaft assembly extends through each of the modules for causing the motor module to rotate the pump module. At least one of the modules has a sleeve extending around the shaft that is of a harder material than the shaft. A torque transmitting ring is deformed between an inner diameter of the sleeve and an exterior portion of the shaft. The inner diameter of the sleeve is a continuous cylindrical surface free of any torque transmitting shoulders. Friction created by the torque transmitting ring transmits the entire rotational force from the shaft to the sleeve.

15 Claims, 4 Drawing Sheets

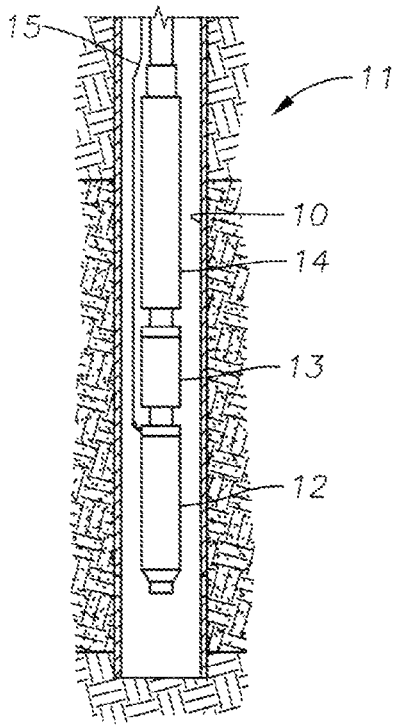
Fig. 1
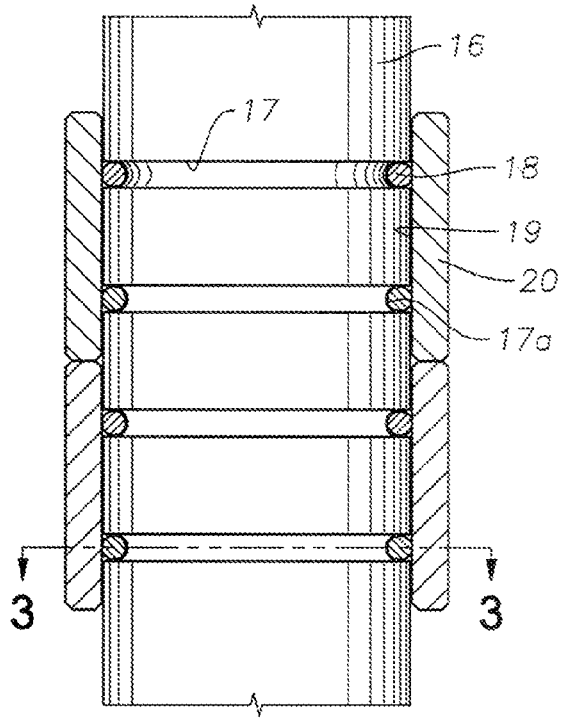
Fig. 2
Fig. 3
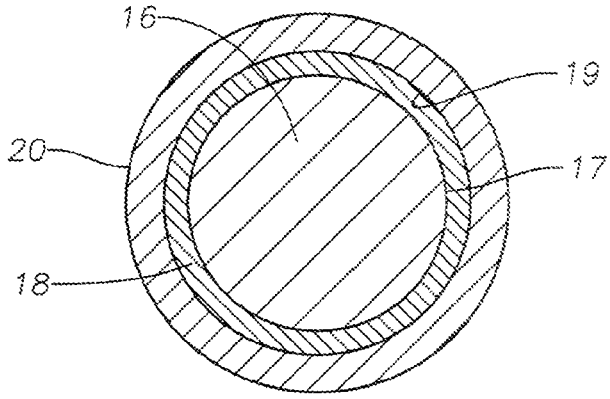

TORQUE TRANSMITTING RINGS FOR SLEEVES IN ELECTRICAL SUBMERSIBLE PUMPS

FIELD

This disclosure relates in general to electrical submersible pump assemblies, and in particular to deformed rings between a shaft and a sleeve of the assembly for transmitting torque from the shaft to the sleeve.

BACKGROUND

Electrical submersible pump assemblies (ESP) for oil wells commonly include an electrical motor, a seal section, and a centrifugal pump. The seal section equalizes the pressure of lubricant within the motor with the well fluid hydrostatic pressure. The motor rotates a shaft that is part of a shaft assembly extending through the seal section and the pump. A rotary gas separator may also be located in the assembly.

The shafts that make up the shaft assemblies can be lengthy, 30 feet or more. Radial bearings in the motor, seal section and pump provide radial support for the shafts of the shaft assembly. The bearings come in sets. One part, often called the bushing, is pressed into a stationary, non-rotating part of the ESP. The other part, often called a sleeve, is fitted onto the shaft for rotation in unison with the shaft. The sleeve and shaft have corresponding keyways fitted with a common key between each other. The keys and keyways transmit the rotation of the shaft to the sleeve.

The ESP has other components that are mounted to the shaft for rotation, such as impellers within the pump. Each impeller has a hub or sleeve that has a matting keyway with the shaft for rotation therewith. Protective sleeves and spacers may also be mounted around the shaft of the pump for rotation with the shaft.

ESP shafts are formed of steel alloys, such as carbon steel, Inconel and Monel. The sleeves are often formed of similar materials. Alternately, ESPs may use tungsten carbide or ceramic bearing, sleeves, impeller hubs and pump stage thrust bearings for certain applications. The purpose is to reduce wear, particularly if abrasives are in the fluids that immerse these components, which will be referred to herein as abrasive resistant (AR) components. The material of AR components is harder than the shafts of the motor, seal section or pump.

One problem that may occur with AR components results from the mating keyway formed in the AR component. The keyway will produce a stress concentration factor that can cause the AR component to crack. Another problem with AR components can arise from thermal expansion. The steel alloy shafts have a much higher coefficient of thermal expansion than either carbide or ceramic materials used in AR components. Because of the differences in thermal expansion, excessive clearances need to be provided between the shaft and AR component. The clearance allows the shaft and AR component to thermally expand during operating conditions. Once the ESP is at full operating temperature, the clearance reduces due to the different thermal expansion coefficients. The excessive clearance that exists between the shaft and the AR component before the shaft and sleeve reach the full operating temperature can result in looseness at startup that may cause excessive vibration until reaching the full operating temperature. The higher the operating temperature, the greater the initial clearance must be. If the initial clearance is sufficiently large, mechanical damage can occur during startup before the system has time to expand.

SUMMARY

In this disclosure, the pump assembly includes a motor, a seal section and a pump. A rotatable shaft assembly extends through the motor, the seal section and the pump. At least one sleeve having a bore receives the shaft assembly. One or more torque transmitting rings are deformed between the bore of the sleeve and the shaft. The deformation of the ring creates a frictional force sufficient to cause the sleeve to rotate in unison with the shaft assembly. A keyway in the bore of the sleeve is not required, which reduces stress concentrations if the sleeve is formed of abrasion resistant materials such as tungsten carbide or ceramic. Thermal expansion differences between these abrasion resistant materials and the steel alloys of the shafts still exist, but a large enough initial clearance can be provided for the full thermal expansion. The squeeze provided by the elastomeric ring reduces vibration at start up and before the clearance reduces due to temperature increase.

The bore of the sleeve comprises a cylindrical surface that is uninterrupted in a 360 degree or completely circumferential direction. That is, it has no shoulders that face in a rotational direction in order to transmit rotation. The torque transmitting ring is located in an annular groove. Preferably, the annular groove is formed on an exterior surface of the shaft assembly. The sleeve may be located within and rotatable relative to a non-rotating stationary member. The outer diameter of the sleeve would be in sliding engagement with the inner diameter of the stationary member. The sleeve could also have an exterior cylindrical surface that is free of any type of engagement with other components of the pump assembly.

In one embodiment, the sleeve and torque transmitting ring are part of a radial bearing for the shaft within the motor. In that instance, a bearing carrier has an exterior in non-rotating engagement with an inner diameter of a stator of the motor. The bearing carrier has an inner diameter that receives the sleeve in sliding engagement. In another embodiment, the sleeve and torque transmitting ring are located within the pump. The sleeve may be a spacer sleeve, an abrasion resistant protective sleeve, a hub of an impeller or a pump stage thrust runner. In another embodiment, the sleeve and torque transmitting ring may be located within the seal section as part of part of a radial bearing.

The torque transmitting ring may be formed of an elastomeric material or other resilient material. The elastomeric material could be a type that swells when immersed in oil. The torque transmitting ring need not serve as a sealing member, although it could operate to seal, if desired. Normally, the sleeve and torque transmitting ring will be positioned in the pump assembly such that a pressure differential across the ring is substantially zero during operation of the pump assembly.

BRIEF DESCRIPTION OF THE DRAWINGS

FIG. 1 is a schematic side view of an electrical submersible pump assembly having components in accordance with this disclosure.

FIG. 2 is a schematic view illustrating a shaft, sleeve and torque transmitting ring for a shaft of the pump assembly of FIG. 1.

FIG. 3 is a sectional view of the shaft, sleeve and torque transmitting ring of FIG. 2, taken along the line 3-3 of FIG. 2.

DETAILED DESCRIPTION

Figure 4:
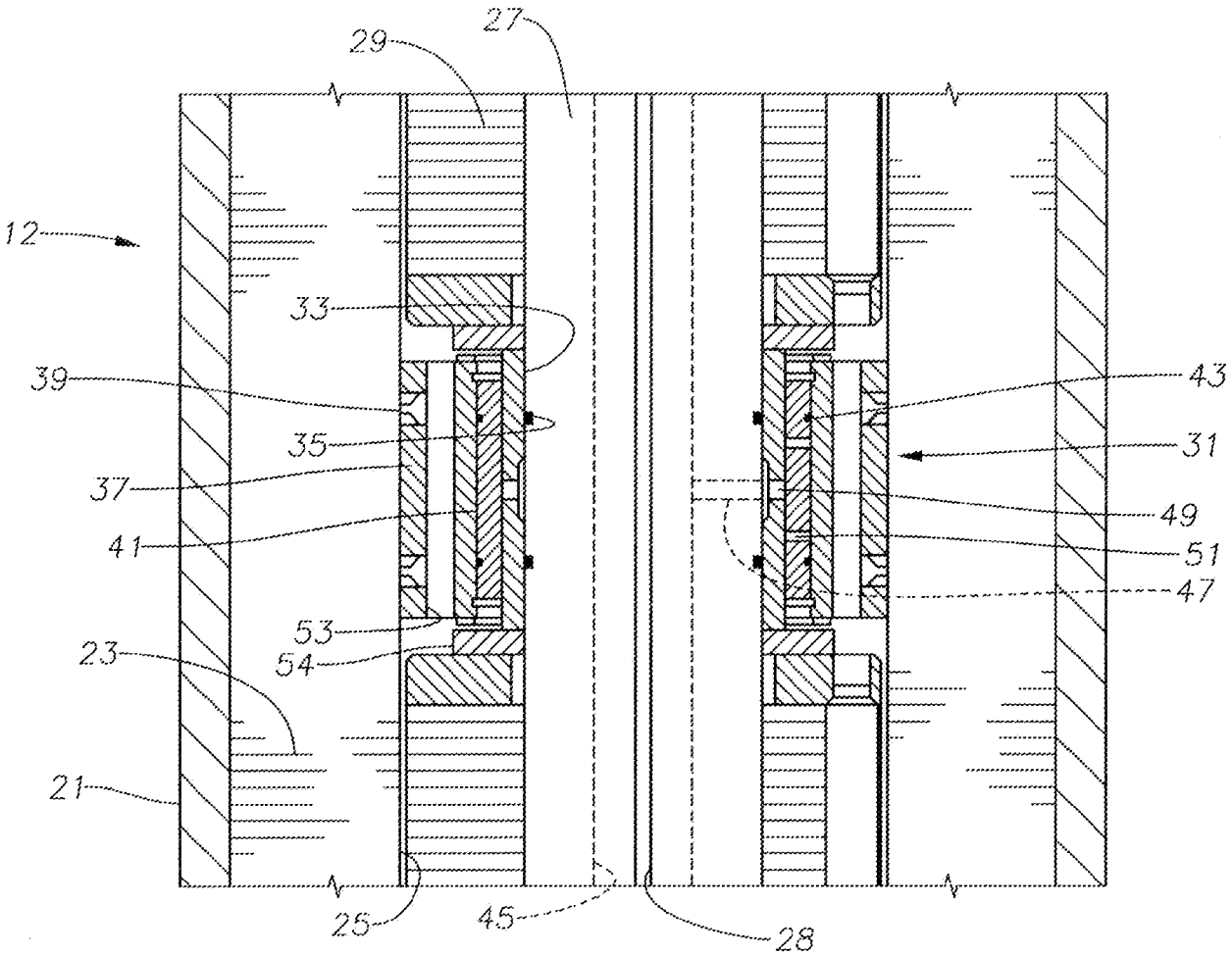
FIG. 4 is a sectional view of a portion of the motor of the pump assembly of FIG. 1.

Referring to FIG. 1, electrical submersible pump assembly (ESP)11 is illustrated within a cased wellbore 10. ESP assembly 11 is suspended within the wellbore for pumping well fluid up from the wellbore. ESP assembly 11 has a motor 12, which is typically an electrical motor. A seal section 13 secures to one end of motor 12, separating motor 12 from a pump 14. Seal section 13 has features within that equalize the pressure of dielectric lubricant within motor 12 with the hydrostatic pressure of the wellbore fluid on the exterior of motor 12. Pump 14 connects to the end of seal section 13 opposite motor 12. In this example, pump 14 comprises a centrifugal pump. Alternately, pump 14 could be a progressive cavity pump or other types. A power cable 15 is illustrated as extending from the surface to motor 12 for supplying electrical power.

Referring to FIG. 2, a shaft assembly 16 extends through pump assembly 11. Shaft assembly 16 normally comprises a separate shaft within motor 12, seal section 13 and pump 14 (FIG. 1), the shafts being coupled together. However, a single shaft could extend through two or more of the components, such as through motor 12 and seal section 13. Shaft assembly 16 has at least one circular or annular groove 17 that extends around the axis of rotation of shaft assembly 16. Each groove 17 is located on the exterior surface of shaft assembly 16, the exterior surface being cylindrical. Each groove 17 will typically have two parallel side walls and a cylindrical or arcuate base 17*a*, providing a generally rectangular configuration if shown in a transverse sectional view.

A torque transmitting ring 18 is mounted in each groove 17. Each torque transmitting ring 18 has a greater radial cross-sectional dimension than the depth of groove 17 from the groove base 17*a* to the cylindrical exterior of shaft assembly 16. Each torque transmitting, ring 18 thus has an outer diameter portion that will initially protrude past the cylindrical exterior surface of shaft assembly 16. Each torque transmitting ring 18 is deformable and resilient. In one embodiment, torque transmitting ring 18 comprises an elastomeric member, such as a rubber material typically employed for a seal ring employed in an. ESP. The material could be made out of an ethylene propylene diene monomer (EPDM) that swells when immersed in oil. Torque transmitting ring 18 could alternately be of a material other than an elastomer, such as metal, if made to be resilient. For example, it could comprise a coil spring. The transverse cross-sectional configuration of torque transmitting ring 18 may be circular, having the same shape as an O-ring seal. Alternately, it may have different transverse cross-sectional shapes, including shapes having a greater radial dimension than its axial dimension. It also could be square or rectangular in cross-section.

A bore 19 of a sleeve 20 slides over torque transmitting ring 18. Bore 19 is cylindrical and has an inner diameter initially greater than the outer diameter of shaft assembly 16. The initial inner diameter of bore 19 is not greater than the outer diameter of torque transmitting ring 18 prior to being deformed. Consequently, sliding sleeve 20 over torque transmitting ring 18 will cause torque transmitting ring 18 to radially deform. Friction increases as a result of the squeeze of torque transmitting ring 18. The configuration and material of torque transmitting ring 18 are selected to create sufficient friction to transmit the torque imposed by rotating shaft assembly 16 to sleeve 20 at start up and at full operating temperatures. Once sleeve 20 has been pushed over torque transmitting ring 18, sleeve 20 will rotate in unison with shaft assembly 16.

More than one torque transmitting ring 18 may be employed for sleeve 20. In this example, two sleeves 20 are illustrated, each having two of the torque transmitting rings 18 in engagement with its bore 19. Alternately, a single sleeve 20 having a length equal to the two sleeves 20 could be employed. Further, four torque transmitting rings 18, more than four, or fewer than four could be employed. Bore 19 of each sleeve 20 is a continuous 360 degree cylindrical surface free of any interruptions in a circumferential direction. That is, there are no keyways in bore 19 or shoulders that face into a circumferential direction of rotation, as shown in FIG. 3.

Sleeve 20 is preferably part of an abrasion resistant (AR) component of ESP assembly 11, and it may be located in one or more of the motor 12, seal section 13, and pump 14. Preferably, sleeve 20 is formed of a material harder than the material of shaft assembly 16, which is normally a steel alloy, such as carbon steel, Inconel, or Monel. Sleeve 20 may be formed of a conventional AR material such as ceramic, tungsten carbide or other carbides. As an example, the material of shaft assembly 16 may have a hardness of about 32 RC. The hardness of an AR material may be about 95 RC. If sleeve 20 is formed of an AR material, the initial clearance between bore 19 and shaft assembly 16 prior to reaching operating temperature may be about 0.0005 inch on a side. At operating temperature, this clearance will decrease, but will not normally completely disappear. The initial difference in diameter produces a clearance that is large enough to accommodate the full thermal expansion of sleeve 20 and shaft assembly 16 from start up to full operating temperature. Although torque transmitting rings 18 could seal against bore 19 if made of elastomeric material, they need not do so to perform the function of transmitting torque. Typically, during operation of ESP assembly 11, the pressure differential across torque transmitting rings 18 will be substantially zero.

FIG. 4 illustrates the arrangement of FIG. 2 as applied to an AR component within motor 12. Motor 12 has a cylindrical or tubular motor housing 21. A stator 23 is fixed within motor housing 21 so as to be non-rotatable. Stator 23 consists of a large number of laminations or disks that are stacked on one another. Conductive wires or windings (not shown) extend through slots located within the disks of stator 23. Stator 23 has a cylindrical inner diameter 25. A shaft 27 extends through inner diameter 25 along the axis of rotation of shaft 27. Shaft 27 is part of shaft assembly 16 (FIG. 2). Shaft 27 optionally may have an axial keyway groove 28 formed in its exterior for driving certain components, such as rotor sections 29. Rotor sections 29 are mounted around shaft 27 for rotation therewith. A key (not shown) would normally extend between rotor sections 29 and keyway groove 28 so that shaft 27 will impart rotation to rotor sections 29.

A radial bearing 31 is located between each rotor section 29 for radially stabilizing shaft 27. Radial bearing 31 includes a sleeve 33 that is mounted around shaft 27 with torque transmitting rings 35 for rotation therewith in the same manner as sleeves 20 of FIG. 2. Sleeve 33 is an AR component preferably formed of a considerably harder material than the material of shaft 27. Torque transmitting rings 35 are of a type described in connection with torque transmitting rings 18 of FIG. 2. Each torque transmitting ring 35 is located within an annular groove similar to groove 17 of FIG. 2. In the embodiment shown in FIG. 4, two torque transmitting rings 35 are employed, each deformed between the inner diameter of sleeve 33 and shaft 27. Sleeve 33 could be part of a variety of different types of shaft radial bearings.

In this example, a bearing carrier 37 mounts stationarily in inner diameter 25 of stator 23. Bearing carrier 37 does not rotate because of anti-rotation rings 39 on its exterior that frictionally engage inner diameter 25 of stator 23. Other devices to prevent rotation, of bearing carrier 37 may be employed instead of anti-rotation rings 39. An insert ring 41 is located between the inner diameter of bearing carrier 37 and the outer diameter of sleeve 33, forming part of the bearing carrier assembly. Insert ring 41 has anti-rotation rings 43 on its exterior that frictionally engage the inner diameter of bearing carrier 37. Insert ring 41 thus is non-rotating, and its inner diameter will be engaged by the outer diameter of sleeve 33 in rotating contact. Insert ring 41 optionally may be formed of an AR material.

Shaft 27 has an axially extending passage 45. A port 47 leads radially from passage 45 to the exterior of shaft 27. Port 47 registers with an annular recess in the inner diameter of sleeve 33. The annular recess communicates with a port 49 extending through sleeve 33. Insert ring 41 has a plurality of holes 51 extending between its inner and outer diameters. Holes 51 serve as orifices to meter liquid lubricant being pumped up passage 45 and out ports 47 through holes 49. The lubricant enters an annular clearance on the inner and the outer diameters of insert ring 41, creating fluid films to dampen vibration. More details of this arrangement are described in U.S. Pat. No. 6,566,774. Bearing carrier 37 has a plurality of axial passages 53 for lubricant flow. Bearing carrier 37 may be axially supported between rotor sections 29 by spacer rings 54. Although if formed of elastomeric material, torque transmitting rings 35 could seal above and below ports 49, it is not necessary in this embodiment.

Figure 5:
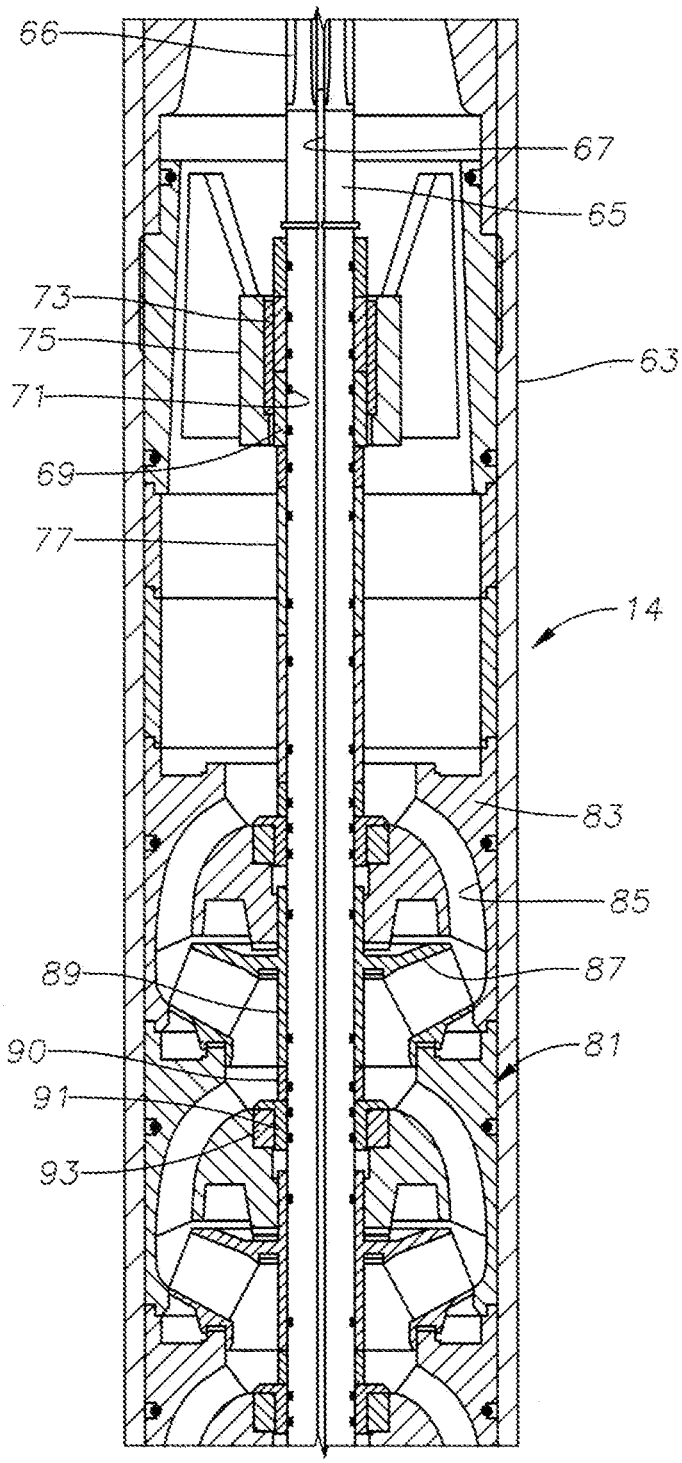
FIG. 5 is a sectional view of a portion of the pump of the pump assembly of FIG. 1.

FIG. 5 illustrates the application of torque rings 18 of FIG. 2 to pump 14. A tubular pump housing 63 concentrically surrounds a shaft 65, which forms a part of shaft assembly 16 (FIG. 2). Shaft 65 has at least one splined end 66 for coupling to other components, such as another pump 14 above and to seal section 13 (FIG. 1) below. Shaft 65 optionally may have an external axially extending keyway groove 67 in the event certain components within housing 63 are to be rotated by a key. A plurality of bearing sleeves 69 is employed in pump 14 to radially stabilize shaft 65. Each bearing sleeve 69 is mounted for rotation in unison with shaft 65 and is formed of an AR material. Each bearing sleeve 69 is driven in rotation by shaft 65 in the same manner as illustrated in FIG. 2. Torque transmitting rings 71 engage the inner diameters of bearing sleeves 69. Torque transmitting rings 71 are located in circumferential grooves formed in the exterior surface of shaft 65. A bushing 73 is stationarily mounted in housing 63 by a bushing carrier 75. Bushing 73 may be press fitted into bushing carrier 75, which is secured by threads or other means to the interior of housing 63. The exterior surfaces of bearing sleeves 69 slidingly engage bushings 73. Bushings 73 may also be formed of an AR material.

In this embodiment pump 14 also has a plurality of protective sleeves 77 formed of an AR material. Sleeves 77 are mounted around shaft 63 in places where the cylindrical exteriors of sleeves 77 do not slidingly engage any structure within pump housing 63. Instead, protective sleeves 77 serve to prevent erosion of shaft 65 due to abrasive fluid flowing around shaft 65. Protective sleeves 77 rotate in unison with shaft 65 because of torque transmitting rings 71 located between their inner diameters and shaft 65.

Pump 14 has a plurality of pump stages 81, which in this embodiment, comprise centrifugal pump stages. Each stage has a diffuser 83 stationarily mounted in housing 63. Diffuser 83 has fluid flow passages 85 that extend inward and upward from the lower to the upper side of each diffuser 83. An impeller 87 mates with each diffuser 83 for delivering fluid to the lower or upstream side of each diffuser 83. Diffusers 83 and impellers 87 may have a variety of configurations, and in this embodiment are shown as mixed flow types. Each impeller 87 has a sleeve or hub 89 that is mounted for rotation with shaft 65. Hub 89 is rotated by torque transmitting rings 71 in the same manner that protective sleeves 77 and bearing sleeves 69 are rotated. Hub 89 is preferably formed of an AR material and joined to the other portions of impeller 87. The material of the remaining portions of impeller 87 may differ than the AR material of hub 89 or the material may be the same.

Pump 14 also includes a number of spacer sleeves 90 located between adjacent stages. In this example, each spacer sleeve 90 is shown abutting a lower end of each hub 89. Spacer sleeve 90 also has one or more torque transmitting rings 71 for causing it to rotate. Spacer sleeve 90 is also formed of an AR material and its cylindrical exterior is free of sliding engagement with any other structure of pump 14.

Each spacer sleeve 90 rests on the upper end of a thrust runner 91 formed of an AR material. Thrust runner 91 is mounted for rotation with shaft 65 in the same manner as discussed above. That is, one or more torque transmitting rings 71 is deformed between the inner diameter of thrust runner 91 and shaft 65. Thrust runner 91 transmits downthrust from an impeller 87 located above it to a thrust base 93 that is stationarily mounted in diffuser 83. Thrust base 93 is also of an AR material. In this example, each pump stage 81 is shown with a thrust runner 91 and thrust base 93. Alternately, a thrust runner 91 and thrust base 93 could be located only in certain pump stages, with conventional stages between. The conventional stages transmit downthrust to the ones having a thrust runner 91 and thrust base 93. The torque transmitting rings 71 for bearing sleeves 69, protective sleeves 77, impeller hubs 89, spacer sleeves 90 and thrust runner 91 could form seals around shaft 65 if made of elastomeric material. However, sealing is not necessary in this embodiment.

Figure 6A:
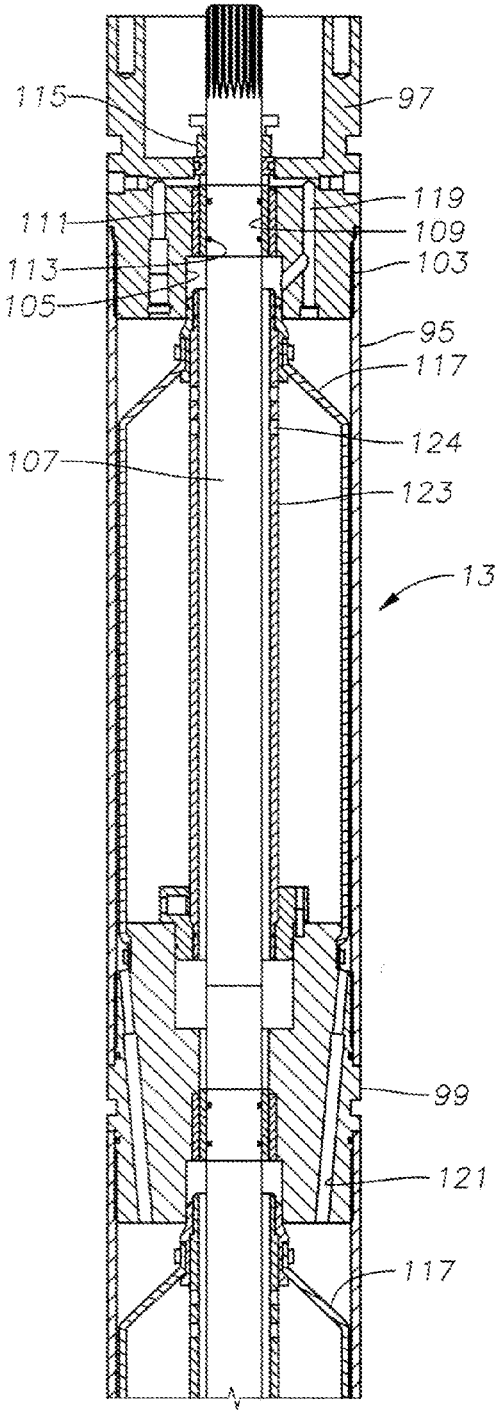
FIGS. 6A and 6B comprise a sectional view of the seal section of the pump assembly of FIG. 1.
Figure 6B:
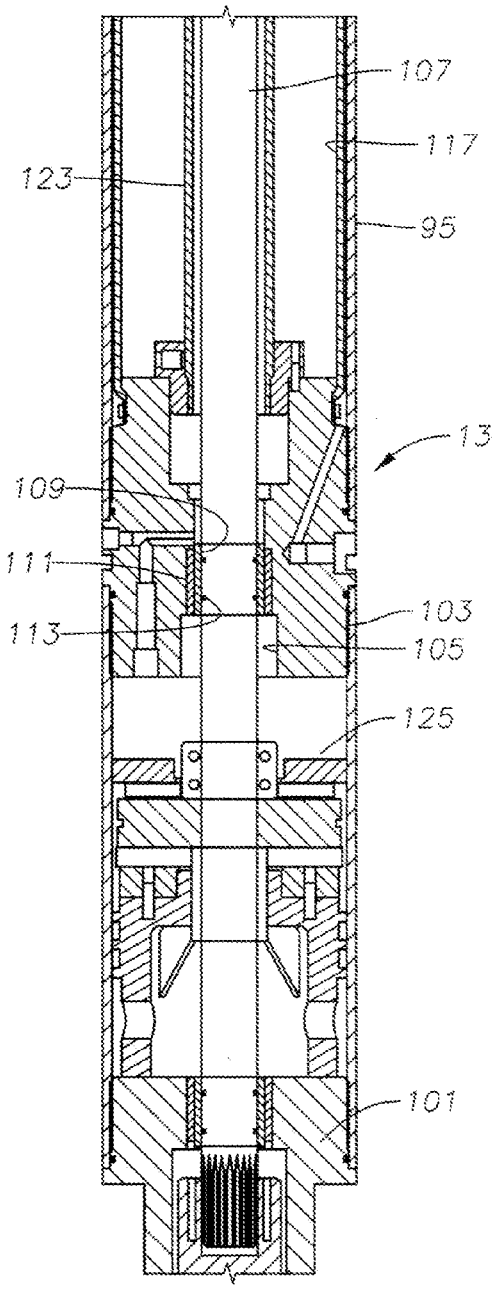

FIGS. 6A and 6B illustrate the application of torque transmitting rings 18 (FIG. 2) to seal section 13. Seal section 13 has a tubular housing 95. An upper connector 97 connects seal section housing 95 to pump 14 (FIG. 1). The upper end of upper connector 97 normally bolts to a similar connector located at the base of pump 14. Seal section 13 optionally may have more than one section of housing 95. This figure shows two sections of housing 95 joined by an intermediate connector 99. A lower connector 101 (FIG. 6B) connects seal section 13 to motor 12 (FIG. 1) by bolts. Each connector 97, 99 and 101 has external threads that engage internal threads in the particular section of housing 95 that they join. Each connector 97, 99 and 101 has an axial passage 105 through which a drive shaft 107 extends. Shaft 107 forms a part of shaft assembly 16 (FIG. 2), and transmits rotation from motor shaft 27 (FIG. 4) to pump shaft 65 (FIG. 5).

Seal section 13 has a plurality of radial bearings for radially stabilizing shaft 107. These bearings include a sleeve 109 that is mounted to shaft 107 for rotation therewith. Sleeve 109 is mounted for rotation in the same manner as sleeves 20 of FIG. 2. Sleeve 109 may be formed of an AR material and rotates within a stationary bushing 111. Torque transmitting rings 113 transmit the rotational force of shaft 15 to sleeve 109. As in the other embodiments, torque transmitting rings 113 need not form a seal. Sealing is accomplished in seal section 13 by means of mechanical face seals 115 in this example.

Seal section 13 has conventional components including a mechanism to equalize the pressure of lubricant in motor 12

(FIG. 1) with the hydrostatic wellbore fluid. In this example, merely for illustration, two bladders 117 are mounted in series, each within a separate section of housing 95. Seal sections with only a single bladder or some other device, such as a serpentine tube arrangement, may also be employed. A well fluid inlet port 119 delivers well fluid into the space surrounding the upper bladder 117. An intermediate well fluid port 121 communicates the well fluid from the chamber in the upper section of housing 95 to the exterior of the lower bladder 117. An oil communication tube 123 is located within each bladder 117. Each oil communication tube 123 communicates lubricant from motor 12 (FIG. 1) into the interior of each bladder 117 via ports 124. Sleeves 109 are initially immersed in dielectric lubricant; eventually, well fluid may come into contact with some or all of sleeves 109.

A thrust bearing 125 may be mounted within seal section 13 for absorbing downthrust from pump 14 (FIG. 1). In this example, keys (not shown) between shaft 107 and the rotating part of thrust bearing 125 transmit the rotational force.

In operation, motor shaft 27 rotates in response to electrical power being supplied down power cable 15 (FIG. 1). As shown in FIG. 4, sleeve 33 rotates in unison with motor shaft 27 as a result of torque transmitting rings 35. Motor shaft 27 rotates seal section shaft 107 (FIG. 6A, 6B). Sleeves 109 rotate in unison with shaft 107 in response to the frictional force imposed by torque transmitting rings 113. Torque transmitting rings 113 cause sleeve 109 to slidingly engage stationary bushing 111 on the exterior. Seal section shaft 107 drives pump shaft 65 (FIG. 5). As shown in FIG. 5, pump bearing sleeves 69 rotate in unison with shaft 65 in response to the torque transmitted via torque transmitting rings 71. Bearing sleeves 69 slidingly engage the inner diameters of bushings 73. Protective sleeves 77, spacer sleeves 90, impeller hubs 89 and thrust runners 91 also rotate with shaft 65 as a result of torque transmitting rings 71. Thrust runners 91 transmit downthrust from the impeller hub 89 located directly above into thrust base 93.

The sole means to transmit rotation from the shaft to the various sleeves comprises the torque transmitting rings. This arrangement reduces the need for forming torque transmitting shoulders within a sleeve, particularly formed of a carbide or ceramic material. Eliminating the torque transmitting shoulders within such sleeves reduces breakage.

While the disclosure illustrates only a few embodiments, it should be apparent to those skilled in the art that it is not so limited but various changes may be made.

The invention claimed is:

1. A centrifugal pump assembly, comprising:

a motor, a seal section and a pump;

a rotatable shaft assembly extending through the motor, the seal section, and the pump;

the pump has a plurality of sleeves, each of the sleeves having a bore that receives the shaft assembly;

a torque-transmitting ring deformed between the bore of each of the sleeves and the shaft assembly, the deformation of the ring creating a frictional force sufficient to cause each of the sleeves to rotate in unison with the shaft assembly, wherein:

the pump has a plurality of stages having a rotating impeller and a non rotating diffuser; and at least one of the sleeves comprises a hub of the impeller of at least one of the stages; at least one of the sleeves comprises a tubular spacer having a bore that receives the shaft assembly, the spacer having one end in engagement with the hub of one of the impellers and another end that transmits downward thrust from the impeller through the hub and the spacer to the diffuser.

2. The pump assembly according to claim 1, wherein the bore of each of the sleeves comprises a cylindrical surface that is uninterrupted in a circumferential direction.

3. The pump assembly according to claim 1, further comprising:

a plurality of annular grooves formed in an exterior surface of the shaft assembly; and wherein each of the torque-transmitting rings is located in one of the grooves.

4. The pump assembly according to claim 1, wherein the hub transmits thrust of the impller downward to the diffuser.

5. The pump assembly according to claim 1, wherein:

the sleeves are formed of an abrasion resistant material that has a greater hardness than the shaft assembly.

6. The pump assembly according to claim 1, wherein:

at least one of the sleeves comprises a thrust runner having a bore that receives the shaft assembly, the thrust runner having a flange that rotatably and slidingly engages a thrust base of the diffuser to transfer thrust from the impeller to the diffuser.

7. The pump assembly according to claim 1, wherein:

at least one of the sleeves comprises a thrust runner having a bore that receives the shaft assembly, the thrust runner having a flange that rotatably and slidingly engages a thrust base of the diffuser; and at least one of the sleeves comprises a tubular spacer having a bore that receives the shaft assembly, the spacer having one end in engagement with the hub of one of the impeller and another end in engagement with the thrust runner to transmit downward thrust from the impeller through the hub, the spacer and the thrust runner to the diffuser.

8. The pump assembly according to claim 1, wherein each of the sleeves is adapted to be immersed within a fluid during operation of the pump assembly, and wherein the sleeves are positioned in the pump assembly such that a pressure differential across the torque-transmitting ring is substantially zero during operation of the pump assembly.

9. An electrical submersible pump assembly, comprising:

a motor module coupled to a seal section module;

a centrifugal pump assembly comprising the limitations of claim 1 coupled to the section module;

a shaft assembly extending through each of the modules that is rotated by the motor module, at least one radial bearing in one of the modules for radially supporting the shaft, the radial bearing comprising:

a bearing sleeve extending around the shaft in at least one of the modules, the bearing sleeve being formed of a harder material than the shaft assembly;

an elastomeric ring deformed between an inner diameter of the bearing sleeve and an exterior portion of the shaft assembly;

the inner diameter of the bearing sleeve and the exterior portion of the shaft assembly being continuous cylindrical surfaces, such that friction created by the elastomeric ring provides a sole torque transmitting force to cause the bearing sleeve to rotate in unison with the shaft assembly; and a bearing carrier assembly having a bore that rotatably and slidingly receives the bearing sleeve, the bearing carrier assembly being non rotatbly mounted in said one of the modules.

10. The pump assembly according to claim 9, further comprising:

an annular groove formed in the exterior portion of the shaft assembly; and wherein the elastomeric ring is located in the groove.

11. The pump assembly according to claim 9, wherein:

the motor module has a stator stationarily mounted in a motor housing, the stator defining an inner diameter; and the bearing carrier assembly is in non-rotating engagement with the inner diameter of the stator.

12. The pump assembly according to claim 9, wherein the bearing sleeve is formed of tungsten carbide, and the shaft assembly is formed of a steel alloy.

13. The pump assembly according to claim 9, wherein the seal section comprises:

a tubular housing having at least one set of internal threads; and wherein the bearing carrier assembly comprises:

at least one connector secured by external threads to the internal threads, the connector having a passageway through which the shaft assembly extends;

a bushing stationarily mounted to the connector within the passageway; and wherein the bearing sleeve is mounted within and in sliding engagement with the bushing.

14. A centrifugal pump assembly, comprising:

a motor, a seal section and a pump;

a rotatable shaft assembly extending through the motor the seal section, and the pump;

at least one sleeve having a bore that receives the shaft assembly:

a torque-transmitting ring deformed between the bore of the sleeve and the shaft assembly, the deformation of the ring creating a frictional force sufficient to cause the sleeve to rotate in unison with the shaft assembly; wherein:

the motor has a non-rotating stator that has an inner diameter;

a bearing carrier assembly has an exterior in non-rotating engagement with the inner diameter of the stator, and the bearing carrier assembly has an inner diameter that receives the at least one sleeve in sliding engagement.

15. A method of pumping a well fluid, comprising:

providing the pump assembly comprising the limitations of claim 1 with an internal routable shaft assembly;

lowering the pump assembly into a well and rotating the shaft assembly and the at least one sleeve relative to the stationary member of the pump assembly, causing the pump assembly to pump the well fluid, the deformation of the torque-transmitting ring creating a frictional force that provides a sole torque transmitting force to cause the at least one sleeve to rotate in unison with the shaft.

* * * * *